US005927704A

United States Patent [19]

Quackenbush et al.

[11] Patent Number: 5,927,704

[45] Date of Patent: Jul. 27, 1999

[54] SHEET FEED APPARATUS PREVENTING IMAGE RUBOFF

[75] Inventors: Raymond M Quackenbush, Rochester; Nicholas Deleo, West Henrietta; Steven P Bailey, Rochester, all of N.Y.; Bradley A Twait, Coronado, Calif.

[73] Assignee: Eastman Kodak Company, Rochester, N.Y.

[21] Appl. No.: 08/794,313

[22] Filed: Feb. 3, 1997

[51] Int. Cl.[6] ..... B65H 3/14

[52] U.S. Cl. ..... 271/98; 271/99; 271/100; 271/105; 271/107; 271/166; 271/3.07

[58] Field of Search ..... 271/3.05, 3.07, 271/98, 99, 100, 101, 104, 105, 107, 165, 166, 167

[56] References Cited

U.S. PATENT DOCUMENTS

| | | | |
|---|---|---|---|
| 3,926,427 | 12/1975 | Moksnes et al. | 271/99 |
| 4,243,316 | 1/1981 | Gustafson . | |
| 4,382,593 | 5/1983 | Beran et al. | 271/104 |
| 4,560,158 | 12/1985 | Wilson . | |
| 4,595,190 | 6/1986 | Amarakoon . | |
| 4,627,606 | 12/1986 | Moore . | |
| 4,813,660 | 3/1989 | Dodd et al. . | |
| 5,014,973 | 5/1991 | Markert | 271/100 |
| 5,062,602 | 11/1991 | Kress et al. . | |
| 5,255,905 | 10/1993 | Reid et al. . | |

FOREIGN PATENT DOCUMENTS

| | | | |
|---|---|---|---|
| 620174 A1 | 10/1994 | European Pat. Off. | 271/101 |
| 4218203 A1 | 12/1993 | Germany | 271/98 |
| 2 111 024 | 6/1983 | United Kingdom | 271/104 |

*Primary Examiner*—H. Grant Skaggs
*Attorney, Agent, or Firm*—Lawrence P. Kessler

[57] ABSTRACT

Apparatus for feeding sheets seriatim from a stack of sheets which substantially prevents image ruboff. Such sheet feed apparatus includes a tray for supporting a stack of sheets. A plate associated with the tray supports the lead edge of the sheet stack. A major portion of the sheet stack, measured from the top of the sheet stack at the lead edge of the sheet stack, is supported by a mechanism associated with the plate. A positive flow of air is directed at a minor portion of the sheet stack, measured from the bottom of the sheet stack at the lead edge of the sheet stack, to enable the minor portion of the sheet stack to be levitated for separation of the sheets in the minor portion of the sheet stack. Sheets are selectively removed seriatim from the bottom of the sheet stack to feed such sheets away from the sheet stack, whereby as a number of sheets are removed from the minor portion of the stack, a substantially similar number of sheets are moved from the major portion of the sheet stack to the minor portions thereof.

11 Claims, 4 Drawing Sheets

SHEET FEED APPARATUS PREVENTING IMAGE RUBOFF

BACKGROUND OF THE INVENTION

The present invention relates in general to apparatus for feeding sheets seriatim from a stack, and more particularly to a sheet feed apparatus which substantially prevents image ruboff.

In typical commercial electrostatographic reproduction apparatus (copier/duplicators, printers, or the like), a latent image charge pattern corresponding to information to be reproduced is formed on a uniformly charged charge-retentive or photo-conductive member having dielectric characteristics (hereinafter referred to as the dielectric member). Pigmented marking particles are attracted to the latent image charge pattern to develop such image on the dielectric member. A receiver member is then brought into contact with the dielectric member, and an electric field applied to transfer the marking particle developed image to the receiver member from the dielectric member. After transfer, the receiver member bearing the transferred image is transported away from the dielectric member, and the image is fixed (fused) to the receiver member by heat and pressure to form a permanent reproduction thereon.

The rate at which such reproduction apparatus make copies can be quite significant (for example from seventy to one hundred thirty copies per minute). Such high copy rates are possible, at least in part, due to advances in feeding document sheets, bearing information to be reproduced, to and from a copy station. One sheet feeder which has been successful in reliably feeding sheets to and from the copy station is commonly referred to as an oscillating vacuum recirculating document feeder. Sheets are withdrawn seriatim, from a sheet stack supported in a tray, by a ported oscillating cylinder. The oscillating cylinder is selectively coupled to a vacuum source. When the ports of the oscillating cylinder are in juxtaposition with the sheet stack, the bottom-most sheet is vacuum tacked to the cylinder. The cylinder is then rotated in a direction to withdraw such sheet from the stack and feed the sheet into a travel path away from the sheet stack.

A pair of driven nip rollers are respectively associated with bearings supported on the oscillating cylinder. The nip rollers cooperate with the bearings to urge the withdrawn sheet in a downstream direction along the travel path. This cooperative arrangement enables a sheet to be transported along the travel path in the downstream direction substantially unimpeded by the oscillation of the oscillating cylinder. Once the sheet is in the nip between the nip rollers and the bearings so as to be under the transport control thereof, the oscillating cylinder can be rotated in the direction reverse to the first direction. Accordingly, the oscillating cylinder will rotate to return the ports to a position for withdrawing the next sheet from the sheet stack.

The described oscillating vacuum recirculating document feeder is very efficient in withdrawing sheets seriatim from the sheet stack. However, due at least in part to pressure points or zones existing between adjacent sheets in the sheet stack, when a sheet is withdrawn from the stack, the material used to form images on the sheets tends to rub off on adjacent sheets. Such image material can be pigmented marking particles or ink for example. Image ruboff can create significant markings on adjacent sheets which may then result in undesirable artifacts in images reproduced from information on the sheets. The problem is even more significant when the sheets are of the duplex type (i.e., information images exist on both sides of a sheet) since the ruboff can occur immediately over information to be reproduced.

The mentioned pressure points or zones causing the ruboff problems are the result of the weight of the sheet stack on zones of contact over the area supporting the sheet stack. For example, certain zones of contact correspond to ribs, oriented in the direction of the sheet travel path, for supporting the sheet stack. These ribs are intended to reduce overall friction contact of the bottom-most sheet and the tray supporting the sheet stack by decreasing the total contact area therebetween. Further, a zone of contact may correspond to the area, oriented in the direction in the plane of a sheet perpendicular to the sheet travel path, where the sheet stack is supported by the oscillating cylinder.

SUMMARY OF THE INVENTION

In view of the foregoing discussion, this invention is directed to a sheet feed apparatus which substantially prevents image ruboff. Such sheet feed apparatus includes a tray for supporting a stack of sheets. A plate associated with the tray supports the lead edge of the sheet stack. A major portion of the sheet stack, measured from the top of the sheet stack at the lead edge of the sheet stack, is supported by a mechanism associated with the plate. A positive flow of air is directed at a minor portion of the sheet stack, measured from the bottom of the sheet stack at the lead edge of the sheet stack, to enable the minor portion of the sheet stack to be levitated for separation of the sheets in the minor portion of the sheet stack. Sheets are selectively removed seriatim from the bottom of the sheet stack to feed such sheets away from the sheet stack, whereby as a number of sheets are removed from the minor portion of the stack, a substantially similar number of sheets are moved from the major portion of the sheet stack to the minor portions thereof.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
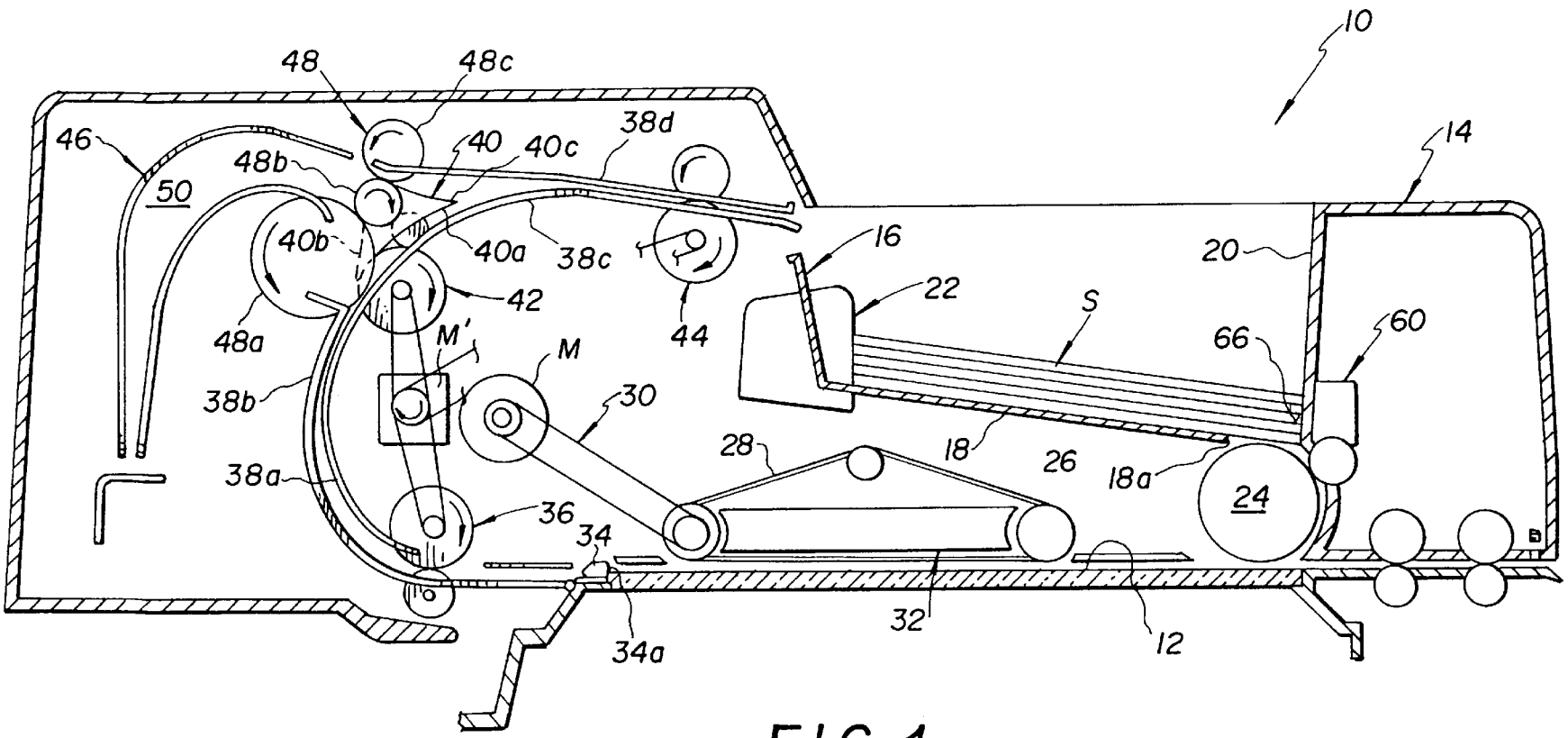
FIG. 1 is a side elevational view, partly in cross-section, of an exemplary oscillating vacuum recirculating document feeder including the sheet feed apparatus for preventing image ruboff according to this invention, with portions removed to facilitate viewing.

Referring now to the accompanying drawings, FIG. 1 shows an oscillating vacuum recirculating document feeder, designated generally by the numeral 10, for use with an electrostatographic reproduction apparatus (not shown) of any suitable well known construction and configuration. The oscillating vacuum recirculating document feeder 10 is shown and described as an exemplary document feeder with which the image ruboff preventing apparatus according to this invention is particularly suitable. Of course, document feeders of many other configurations may employ this invention.

The oscillating vacuum recirculating document feeder 10 is constructed to present simplex or duplex document sheets in juxtaposition with a transparent platen 12 of a reproduction apparatus so that simplex or duplex reproductions may be made by the reproduction apparatus. The recirculating document feeder 10 includes a housing 14 within which a hopper 16 is located for supporting a set of document sheets S. The hopper 16 comprises a readily accessible tray 18 angled downward from the horizontal toward a striker plate 20. Document sheets placed on the tray 18 by an operator in a particular facial orientation (or returned to the tray by the roller set 44 described below) are urged by gravity against the plate 20 for alignment of the forward edges of such sheets. A jogger and set-completed detector 22 (for example, such as described in U.S. Pat. No. 4,169,674, issued Oct. 2, 1979, in the name of Russel), located at the opposite end of the tray 18, urge the sheet stack up against the plate 20.

An oscillating vacuum feeder 24 is located in juxtaposition with an opening 18*a* in the tray 18. The oscillating vacuum feeder 24 is selectively activated (by any suitable drive mechanism not shown) to vacuum tack the bottom-most sheet in the set S to the peripheral surface thereof, and remove such sheet form the set by rotating in a clockwise direction to advance such sheet to a transport mechanism 26. The transport mechanism 26 comprises a ported belt 28 entrained about rollers describing a closed loop travel path for such belt. One of the entraining rollers is coupled by any well known belt-and-pulley mechanism 30 to a motor M to selectively drive the ported belt 28 in a direction about its closed loop path to drive the belt in a clockwise direction about its closed loop path. A vacuum plenum 32 is located within the closed loop path of the ported belt 28 and has a ported bottom plate whereby vacuum from the plenum is effective through the ported plated and the ported belt to tack a document sheet to the belt for transport therewith relative to the platen 12 (i.e., from right to left in FIG. 1).

During exposure, a document sheet is stopped over the platen 12. To ensure that the document sheet is in proper register so that the reflected light image of the information contained thereon is accurately reproduced on a receiver sheet by the reproduction apparatus, a registration gate 34 is provided adjacent to one edge of the platen 12. The registration gate 34 is movable to a first position intercepting the travel path of a document sheet advanced across the platen, or to a second elevated position out of such travel path to enable the sheet to pass the registration gate (for a more complete description of a suitable registration gate and the mechanism for moving the gate to its first or second position, see for example U.S. Pat. No. 4,243,316, issued Jan. 6, 1981, in the name of Gustafson). When the registration gate 34 is in its first position, the lead surface 34*a* of the gate provides an edge against which a document sheet advanced by the belt 28 of the transport mechanism 26 is stopped at a registered location on the platen; and when the gate is in its second position, the mechanism 26 advances the sheet past the gate to a set of exit nip rollers 36.

The exit nip rollers 36 are driven in the indicated direction, through a belt-and -pulley mechanism, by the motor M'. When reproduction of information contained on only one face of the respective document sheets (e.g., simplex document sheets) in set S is desired, the exit nip rollers 36 advance the sheet form the platen 12 into a path described by guides 38*a*–38*d* and diverter 40 (located in the positions shown in FIG. 1). Additional nip roller sets 42 and 44, also driven for example by motor M', advance the document sheet along such path to return the sheet to the hopper 16. On return to the hopper, the document sheet is received on the top of the set in the same facial orientation as its initial facial orientation in the set. The document sheet set S is initially placed in the hopper 16 with the respective information-containing faces of each sheet being oriented face up. Ideally the document sheet set is in page sequential order with the first page on top. In this manner, the document sheets are advanced seriatim from the hopper 16, last page first, advanced along a travel path with their respective information-containing faces directed toward the platen 12, exposed at the platen, and returned to the hopper in their initial facial orientation. Reproductions of the set would then be made at the full reproduction rate of the reproduction apparatus.

In order to maximize the use of the full reproduction rate of the reproduction apparatus in making reproductions of information contained on both faces of the respective document sheets in a document sheet set S (i. e., duplex document sheets), a turnover device 46 is provided. The turn-over device 46 includes a three-roller cluster 48. The middle roller 48*b* of the three-roller cluster is coaxially located on the pivot axis of the diverter 40. The turn-over device 46 also includes a sheet receiving chamber 50, the boundaries of which are formed by suitable guide plates and a resilient stop member. To employ the turn-over device 46 for turning over a document sheet, the diverter 40 is moved from its position where its surface 40*a* defines the document sheet travel path for returning a sheet directly to the hopper 16 to a position where surface 40*b* intercepts the document sheet travel path. With the rollers of the three-roller cluster 48 rotating in the directions as indicated in FIG. 1, the document sheet is directed by the surface 40*b* of the diverter 40 into the nip between rollers 48*a* and 48*b* and advanced into the chamber 50. The document sheet is guided by the guide plates in a direction toward the resilient stop member. When the lead edge of the document sheet strikes the resilient stop member, it rebounds thereby reversing the direction of travel of the document sheet so that the lead edge becomes the trail edge. Due to the shape of the chamber 50 and the beam strength of the document sheet, the new lead edge of the moving document sheet is redirected to enter the nip between rollers 48*b* and 48*c* to advance the sheet over surface 40*c* of the diverter 40. The document sheet is thus returned to the travel path defined by guides 38*c*, 38*d* in a turned over condition for delivery to the hopper 16 with the facial orientation thereof being opposite to its initial facial orientation.

As noted above, oscillating vacuum type document feeders are susceptible to inducement of undesirable marking of document sheets fed by such feeders due to ruboff of image material forming the information on the respective document sheets. With an oscillating vacuum feeder such as the recirculating document feeder 10 described above, several zones of pressure which have the potential for causing document marking can be seen. One particular pressure zone, bearing the weight of the document sheet stack S, is found along an element of the oscillating vacuum feeder 24 beneath the opening 18*a* in the tray 18. Other pressure zones may be found in the tray itself where, heretofore, longitudinal ribs in the direction of sheet travel have been provided to reduce the area over which frictional drag on sheets as they are removed would occur. The invention for to the recirculating document feeder 10, described below, is provided to substantially eliminate such pressure zones and thereby substantially prevent image ruboff.

Figure 2:
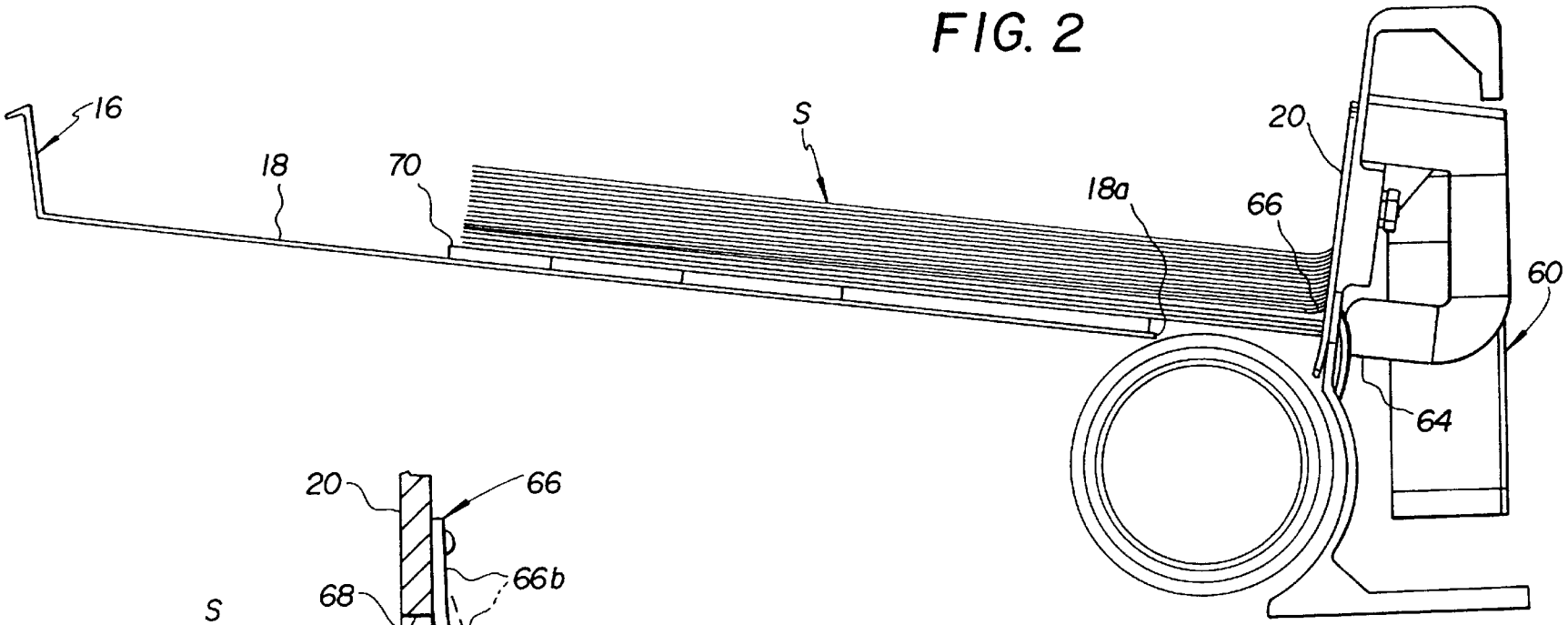
FIG. 2 is a side elevational view, on an enlarged scale, of a portion of the sheet feed apparatus for preventing image ruboff according to this invention shown in FIG. 1.
Figure 3:
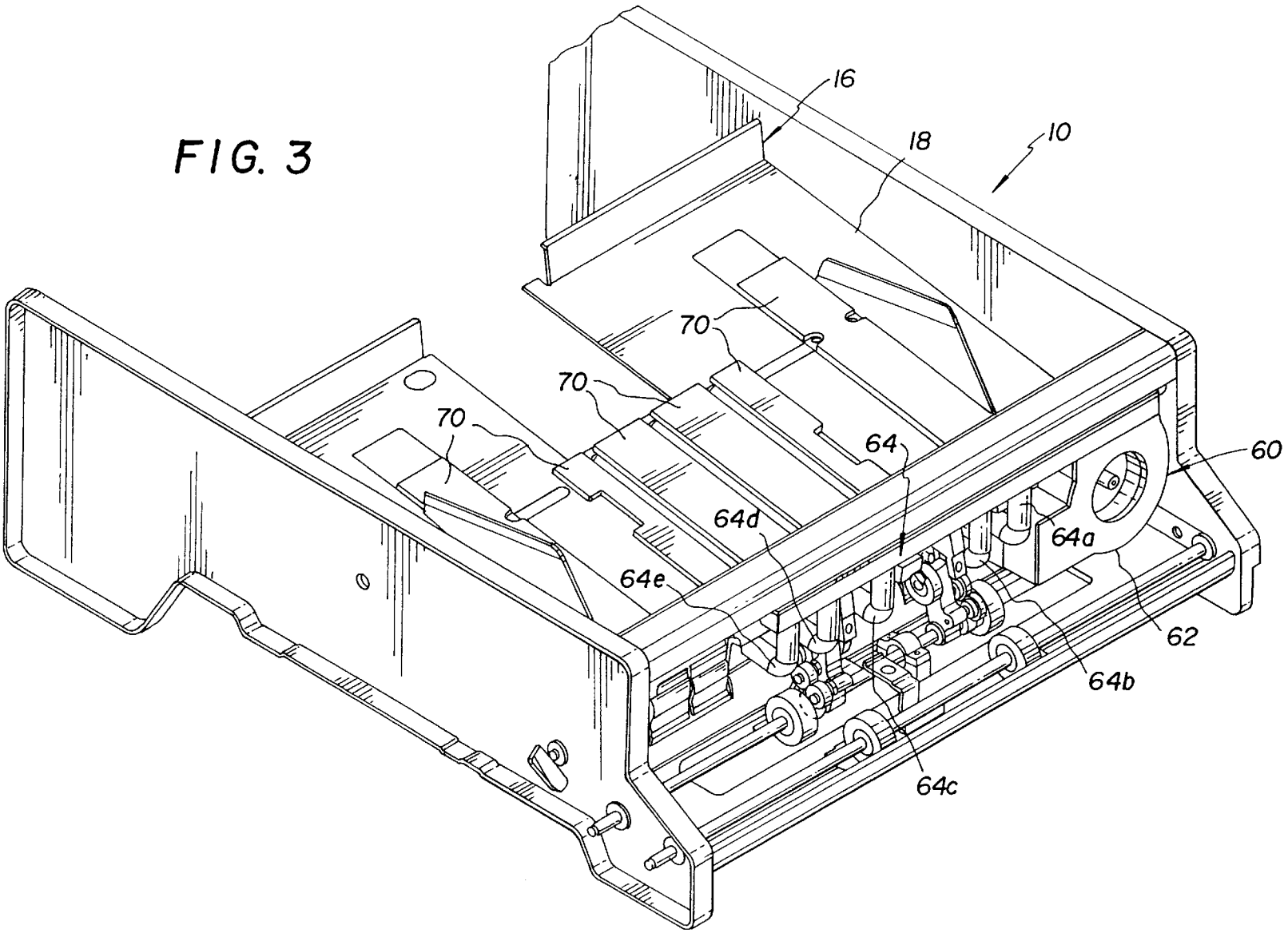
FIG. 3 is a top front view, in perspective, of the sheet feed apparatus for preventing image ruboff according to this invention shown in FIG. 1.
Figure 4:
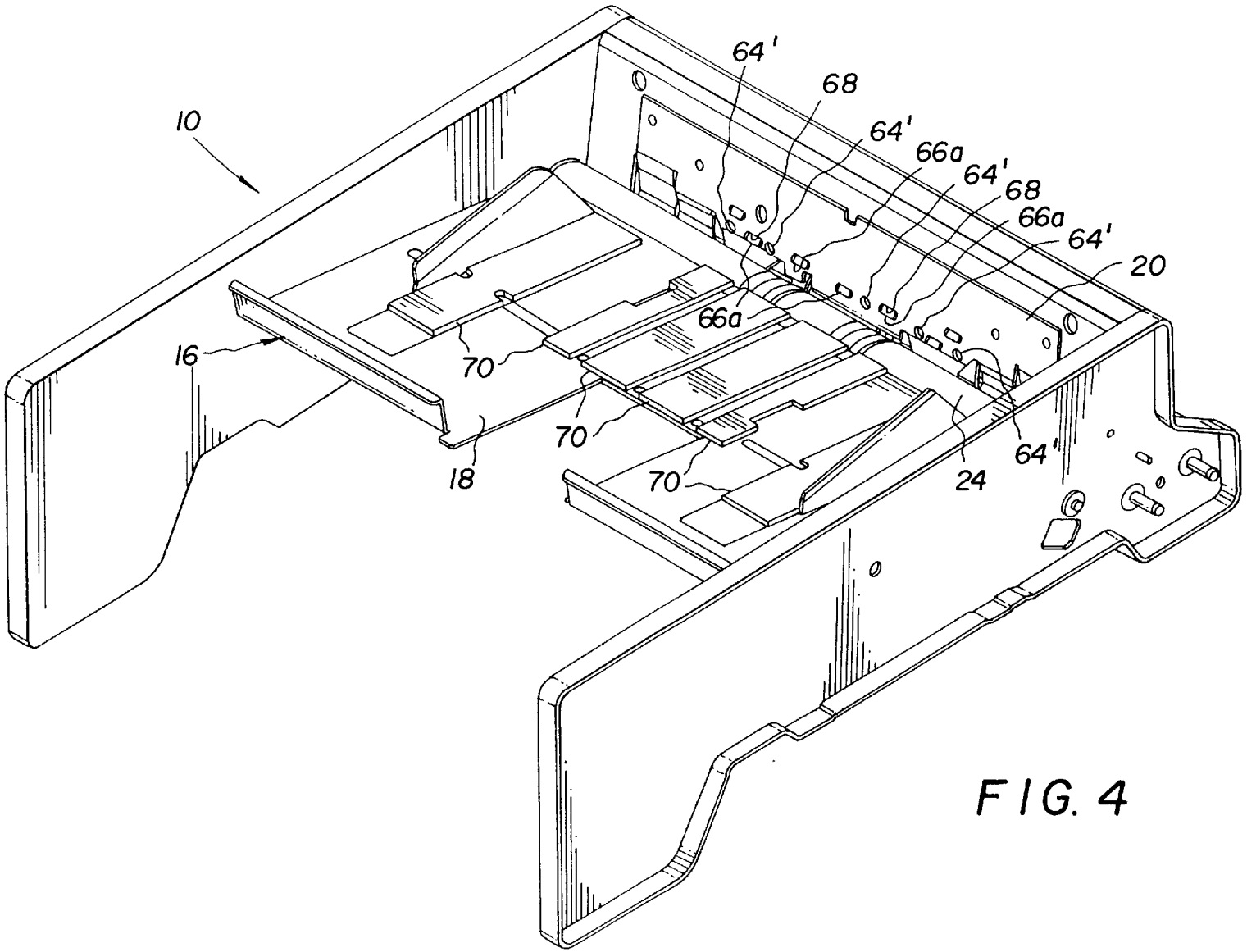
FIG. 4 is a top rear view, in perspective, of the sheet feed apparatus for preventing image ruboff according to this invention shown in FIG. 1.

The recirculating document feeder 10, with ruboff prevention according to this invention, includes an air moving device such as a blower assembly 60 (see particularly FIGS. 2 and 3) adapted to levitate the bottom document sheets in the stack S supported on the tray 18 (i.e., a minor portion of the sheet stack). The blower assembly 60 has a fan 62 in flow communication with an air knife 64 for supplying a constant pressurized air flow to the air knife. The air knife 64 includes multiple jets (e.g., five jets 64*a*–64*e* shown) aimed directly at the lead edge of the document sheet stack on the tray 18, through openings 64' in the striker plate 20, at the bottom of such stack to create an air bearing effect between the bottom sheets in the stack. As an illustrative example, the air knife 64 may produce a static pressure of between about 1.2 and 1.4" $H_2O$, with a flow rate of approximately 10–12 CFM. This pressurized air flow is sufficient to levitate the bottom fifteen to twenty sheets of a sixty sheet stack. The air bearing formed between the bottom sheets substantially eliminates the intimate contact between the sheets in the tray 18 and along the element of the oscillating vacuum feeder 24 otherwise supporting the sheet stack. Ruboff of image material from one sheet to the next, when the bottom-most document sheet is removed from the sheet stack S by the oscillating vacuum feeder 24, is thereby prevented.

Figure 5:
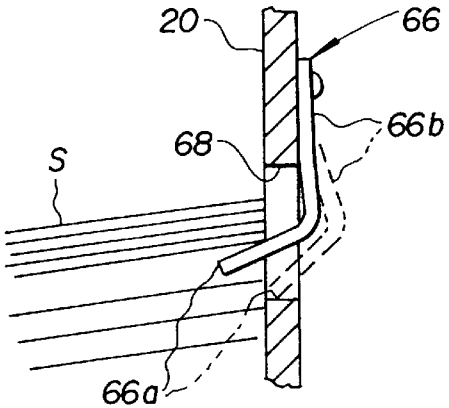
FIG. 5 is a side elevational view, on an enlarged scale of the mechanism associated with the striker plate of the sheet feed apparatus, according to this invention, for supporting the major portion of the sheet stack on the tray of the sheet feed apparatus.

At the same time, the top document sheets in the stack on the tray 18 are supported at the lead edge against the striker plate 20 by tabs 66. The tabs 66 are substantially L-shaped in configuration (see FIG. 5). The arms 66*b* of the tabs are attached at their respective remote ends to the striker plate 20. The fingers 66*a* of the tabs extend respectively through openings 68 in the striker plate 20 to support the top document sheets at the lead edge. The tabs 66 are formed of a material which has a degree of flexibility, particularly over the span of the arms 66*b*. For example, the tabs 66 may be formed of a polyester material such as that known by the name Mylar™. Accordingly, as the bottom sheets are fed out from the stack, the tabs periodically flex out of the way of the top document sheets enabling the top sheets become the bottom sheets. Meanwhile, if sheets are returned to the document sheet stack on the tray 18, such sheets will be supported by the tabs 66. In this manner the weight of the sheet stack at the lead edge is maintained below the maximum value where the air flow stream from the blower assembly 60 is sufficient to levitate the bottom sheets.

More specifically, the oscillating vacuum feeder 24 removes document sheets, levitated in the air flow stream created by the blower assembly 60, seriatim from the bottom of the document sheet stack S in the tray 18. As the document sheets are removed, the top sheets will begin to drop. Once the top sheets have dropped to a certain level, the lead edges of such sheets (heretofore supported by the tabs 66) will ratchet beyond the fingers 66*b* of the tabs 66, with the arms 66*a* flexing from the solid line position of FIG. 5 to the phantom line position and then back to the solid line position. These document sheets then come under the influence of the air flow stream and are levitated in the above described manner.

The tabs 66 serve an additional function, particularly applicable to low stack heights. The fingers 66*b* of the tabs act as a stop to prevent the lead edges of document sheets from rising up (above the fingers) under the influence of the air flow stream so as to maintain control over the lead edges of the sheets. This enhances sheet handling performance in that the sheets remain located, relative to the oscillating vacuum feeder, where they may be readily and accurately acquired by the vacuum forces for proper feeding from the sheet stack. Further, the maintaining control over the lead edges of the sheets prevents damage thereto.

In view of the above, it can be seen that the tabs 66 serve a duel function. First, they support approximately 66% of the number of sheets in the a sheet stack on the tray 18 of the document sheet feeder 10 (i.e., a major portion of the sheet stack to about ⅔ the height of the stack, with the remaining minor portion of the sheet stack being under the levitation effect of the air flow from the blower assembly); and second, they prevent sheets from rising too high in the feeder to be accurately acquired for feeding from the sheet stack by the oscillating vacuum feeder 24. As such, the need for a sophisticated and costly variable air control and valve system is eliminated. Further, the constant air flow stream generated by the blower assembly 60 can be substantially reduced when compared to a system which must provide for control for an entire stack weight. This means that the size (and cost) of the blower utilized in the air moving device is substantially reduced.

As noted above, another pressure zone within the oscillating vacuum feeder such as the recirculating document feeder 10 is defined by longitudinal ribs, in the direction of sheet travel, formed in the tray 18 to reduce the area over which frictional drag on sheets as they are removed would occur. Moreover this pressure zone becomes more pronounced toward the trail edge of the document sheet stack (i.e., opposite the lead edge engaging the striker plate 20). This is due to the fact that the air bearing effect of the air flow stream diminishes as the distance from the air jets 64 increases. To eliminate such pressure zones a low profile plush material 70 is provided on the tray 18. The plush material 70 supports an increased portion of the bottom document sheet, and thus increases the area of contact between the tray and such sheet. Since the area of contact is increased, the pressure on the sheet is decreased thereby reducing the potential for undesirable marking particle ruboff. Further, the characteristics of the plush material 70 cause the material to act as a soft, compressible surface. Such a "living" surface accommodates for any irregularities in flatness and/or straightness of the tray 18 which would otherwise become undesirable points or zones of high pressure.

The invention has been described in detail with particular reference to the preferred embodiment thereof, but it will be understood that variations and modifications can be effected within the spirit and scope of the invention as set forth in the claims.

What is claimed is:

1. Apparatus for feeding sheets seriatim from a stack of sheets, said apparatus comprising:

a tray for supporting a stack of sheets;

a plate associated with said tray and against which the lead edge of said sheet stack is aligned;

a support, associated with said plate, for a major portion of said sheet stack, measured from the top of said sheet stack, at the lead edge of said sheet stack, said support including a plurality of tabs attached to said plate, said plurality of tabs respectively including a flexible aim fixed at one end to said plate and a finger extending from the other end of said flexible arm, said plate including a plurality of openings through which said fingers of said plurality of tabs extend respectively, said fingers of said tabs being respectively configured so as to prevent sheets in the minor portion of said sheet stack, levitated for separation of the sheets in said minor portion of said sheet stack, from moving from the minor portion of said sheet stack into the major portion of said sheet stack; and a blower assembly for moving a positive flow of air toward a minor portion of said sheet stack, measured from the bottom of said sheet stack at the lead edge of said sheet stack, to enable the minor portion of said sheet stack to be levitated for separation of the sheets in the minor portion of said sheet stack;

whereby when sheets are fed seriatim from the bottom of said sheet stack to feed such sheets away from said sheet stack, as a number of sheets are removed from the minor portion of said stack, said support enables a substantially similar number of sheets to move from the major portion of said sheet stack to the minor portion thereof.

2. The sheet feed apparatus according to claim 1 wherein said tray has substantial surface area contact with the bottom-most sheet in said sheet stack, said surface area of said tray supporting said sheet stack including a material having soft, compressible characteristics.

3. The sheet feed apparatus according to claim 1 wherein said plurality of openings in said plate for said tab fingers are respectively located such that said fingers, extending through said openings, support the lead edge of approximately the topmost 66% of said sheet stack.

4. The sheet feed apparatus according to claim 1 wherein said blower assembly includes a constant flow fan, and a plurality of air jets in flow communication with said fan to receive positive air flow therefrom.

5. The sheet feed apparatus according to claim 4 wherein said plate includes a plurality of openings associated respectively with said plurality of air jets.

6. Apparatus for feeding sheets seriatim from a stack of sheets, said apparatus comprising:

a tray for supporting a stack of sheets, said tray being oriented at an angle to the horizontal such that said stack of sheets is urged by the force of gravity in a first direction;

a plate associated with said tray for supporting the lead edge of said sheet stack against movement in said first direction against the force of gravity;

a plurality of tabs for supporting a major portion of said sheet stack, measured from the top of said sheet stack, at the lead edge of said sheet stack, said plurality of tabs respectively including a flexible aim fixed at one end to said plate on the opposite side from the side against which said sheet stack is aligned, and a finger extending from the other end of said flexible arm, said fingers of said tabs are respectively configured so as to prevent sheets in the minor portion of said sheet stack, levitated for separation of the sheets in said minor portion of said sheet stack, from moving from the minor portion of said sheet stack into the major portion of said sheet stack, and said plate defines a plurality of openings through which said fingers of said plurality of tabs extend respectively;

an air source for directing a positive flow of air at a minor portion of said sheet stack, measured from the bottom of said sheet stack at the lead edge of said sheet stack, in a second direction substantially opposite said first direction to enable the minor portion of said sheet stack to be levitated for separation of the sheets in said minor portion of said sheet stack; and a feeder for selectively removing sheets seriatim from the bottom of said sheet stack to feed such sheets away from said sheet stack whereby as a number of sheets are removed from the minor portion of said stack, said supporting means enable a number of sheets to move from the major portion of said sheet stack to the minor portions thereof.

7. The sheet feed apparatus according to claim 6 wherein said plurality of openings in said plate for said tab fingers are respectively located such that said fingers, extending through said openings, support the lead edge of approximately the topmost 66% of said sheet stack.

8. The sheet feed apparatus according to claim 6 wherein said surface area of said tray supporting said sheet stack includes a low profile, plush material having soft, compressible characteristics.

9. The sheet feed apparatus according to claim 6 wherein said means for directing a positive flow of air at a minor portion of said sheet stack includes a constant flow fan, and a plurality of air jets in flow communication with said fan to receive positive air flow therefrom.

10. The sheet feed apparatus according to claim 9 wherein said plate includes a plurality of openings associated respectively with said plurality of air jets.

11. The sheet feed apparatus according to claim 10 wherein said feeder for selectively removing sheets seriatim from the bottom of said sheet stack to feed such sheets away from said sheet is an oscillating vacuum feeder.

* * * * *

UNITED STATES PATENT AND TRADEMARK OFFICE

CERTIFICATE OF CORRECTION

PATENT NO. : 5,927,704
DATED : Jul. 27, 1999
INVENTOR(S) : Raymond M. Quackenbush, et al It is certified that error appears in the above-identified patent and that said Letters Patent is hereby corrected as shown below:

Title page, insert the following:

--Related U.S. Application Data
[60] Provisional application No. 60/017,875, May 14, 1996—

Column 1, line 2, insert the following:

--CROSS REFERENCE TO RELATED APPLICATION
Reference is made to and priority claimed from U.S. Provisional application Ser. No. US 60/017,875, filed May 14, 1996, entitled SHEET FEED APPARATUS PREVENTING IMAGE RUBOFF.--

Signed and Sealed this

Twelfth Day of September, 2000

*Attest:*

Q. TODD DICKINSON

*Attesting Officer*

*Director of Patents and Trademarks*